US005890355A

United States Patent [19]

König

[11] Patent Number: 5,890,355

[45] Date of Patent: Apr. 6, 1999

[54] METHOD OF AND APPARATUS FOR PRODUCING THICK/THIN EFFECTS IN AN INCOMPLETELY-ORIENTED FILAMENTARY PRECURSOR YARN

[75] Inventor: Günter König, Uhingen, Germany

[73] Assignee: Zinser Textilmaschinen GmbH, Ebersbach/Fils, Germany

[21] Appl. No.: 823,639

[22] Filed: Mar. 25, 1997

[30] Foreign Application Priority Data

Mar. 25, 1996 [DE] Germany ..... 196 11 722.4
Jun. 28, 1996 [DE] Germany ..... 196 26 031.0

[51] Int. Cl.[6] ..... D01H 13/26

[52] U.S. Cl. ..... 57/287; 28/240; 28/245; 28/246; 57/6; 57/288

[58] Field of Search ..... 57/287, 288, 6, 57/9, 310; 28/240, 245, 246

[56] References Cited

U.S. PATENT DOCUMENTS 3,104,516 9/1963 Field ..... 57/6
3,137,911 6/1964 Bromley ..... 28/240
3,144,747 8/1964 Palm et al. ..... 57/6
3,263,298 8/1966 Holton ..... 57/310
3,605,393 9/1971 Schroeder ..... 57/6
4,058,968 11/1977 Benson ..... 57/6
4,068,358 1/1978 Luther ..... 28/272

FOREIGN PATENT DOCUMENTS 6-123021 5/1994 Japan ..... 57/6

*Primary Examiner*—William Stryjewski
*Attorney, Agent, or Firm*—Herbert Dubno

[57] ABSTRACT

A method of and apparatus for producing a thin/thick effect yarn provides a thin/thick effect by segmentwise stretching of a filamentary precursor yarn which is combined with a fully-stretched filamentary precursor yarn so that the latter supports the former. The combination can be effected by twisting, nub entanglement or winding of one yarn around the other.

17 Claims, 5 Drawing Sheets

FIG. 2
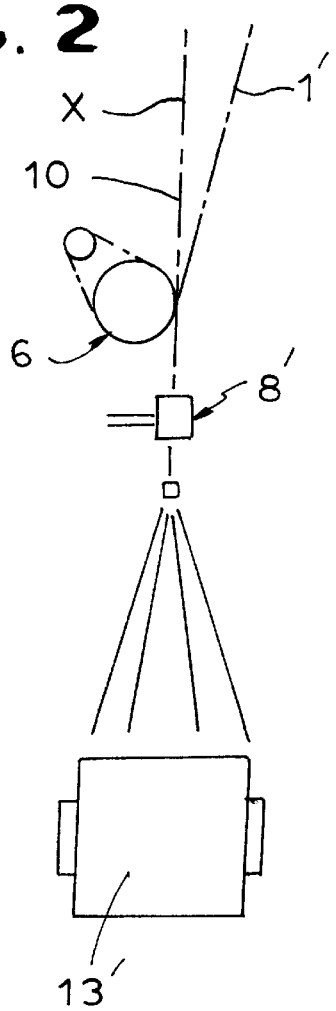
FIG. 3
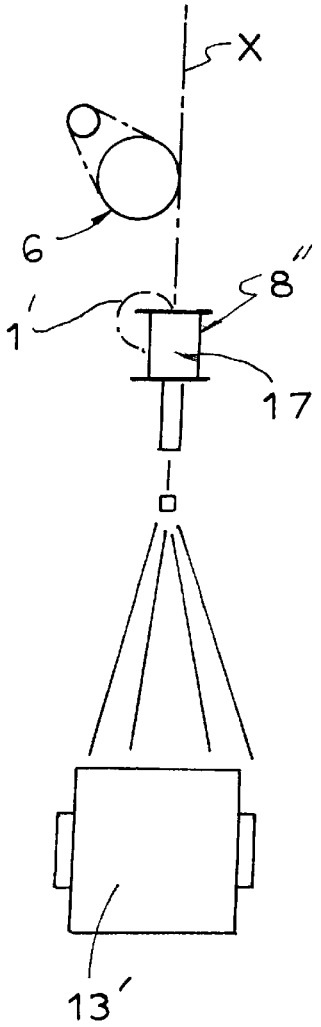
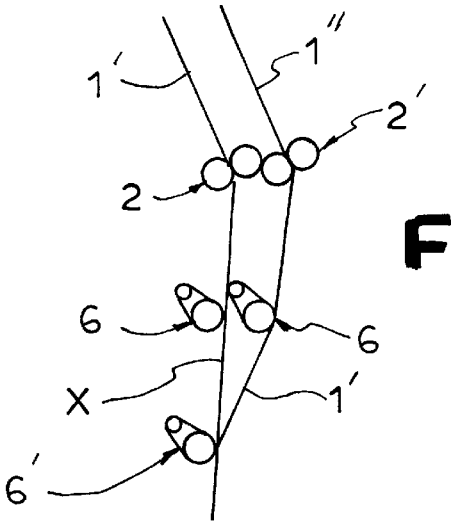
FIG. 7

METHOD OF AND APPARATUS FOR PRODUCING THICK/THIN EFFECTS IN AN INCOMPLETELY-ORIENTED FILAMENTARY PRECURSOR YARN

FIELD OF THE INVENTION

My present invention relates to a method of and to an apparatus for the production of a thick/thin effect in a filamentary yarn utilizing selective stretching with, for example, variation in the tension applied during the stretching operation by releasing tensioned yarn selectively or selectively increasing the resistance to the tension to form regions along the length of the yarn of greater thickness and lesser thickness.

BACKGROUND OF THE INVENTION

It is already known, in connection with filament yarns, i.e. yarns which are spun from synthetic resin filaments and can be single-thread and/or multiple filament yarns, to produce a thick/thin effect or a thin/thick effect in the yarn by selectively stretching of certain regions to thin the yarn while allowing intervening portions of the yarn to be stretched to a lesser extent or not stretched at all and thereby form thicker regions.

In practice, however, such yarns have not been highly successful since, especially because of the poor crystalline characteristics of the lesser stretched regions, the strength of the yarn can deteriorate rapidly or is limited, especially under the influence of light. The products which are produced have the drawback that the strength of the yarn is limited and, especially with time and exposure to light, tends to reduce drastically. Threads or yarns can then fail, especially with intensive multi-year exposure to intensive light because their strength over time can drop to a third of the starting strength while the elongation to break can fall from say 30% to about 5%, representing a significant qualitative decline.

OBJECTS OF THE INVENTION

It is, therefore, the principal object of the present invention to provide an improved method of producing a thick/thin effect in a filament yarn, whereby these drawbacks are avoided.

Another object of the invention is to provide a method of and apparatus for producing thick/thin effect yarns in which the aforedescribed reduction in strength with time and of exposure to light is excluded and the products produced will have long-term relatively high strength although there may be portions at the thick locations, for example, which have not been fully stretched and thus have not received the full orientation which has been found to contribute to the high strength of filament yarns.

Another object of this invention is to provide a method of and an apparatus for producing a thick/thin effect filament yarn in which the fall off of strength with time and exposure to light because of the presence of incompletely stretched thick regions is reduced, rendered negligible or eliminated.

SUMMARY OF THE INVENTION

The invention utilizes the fact that a completely stretched filament is maximally oriented and has maximum strength as these terms are used in connection with spun or extruded synthetic resin filaments. It will be understood that, when a reference is made here to a fully stretched yarn, I intend to thus indicate a degree of stretching of that yarn which is conventionally recognized as the degree of stretching which results in maximum strength of the particular filaments or a multi-filament yarn containing same. The term "precursor yarn" or "precursor filaments" as used herein is intended to refer to a yarn or filament which has not been fully stretched in previous fabrication steps or one which has not been stretched at all and can be subjected to further stretching, whether to an intermittent stretching process leading to thin/thick regions or thick/thin regions, or completely or fully stretched to result in a uniform thickness filament or yarn of maximum strength.

The precursor filament or yarn may derive directly from a filament or yarn fabrication operation or from a yarn package upon which the yarn has been wound in a previous stage. Finally, as a preliminary matter, I may refer here to a yarn-finishing step or a plurality of yarn-finishing steps with which I intend to indicate that portion of the yarn production process at which, following the last of the yarn-finishing stages or steps, no further stretching of the composite yarn is carried out.

The effect yarn which is produced can be then used directly in the production of fabric or can be spun or twisted into ply yarns as is conventional without significant additional stretching. The reference to yarn-finishing is then an indication that there have been preliminary steps involved in the production of the yarn, for example, the spinning or extrusion of the filaments.

Bearing the foregoing in mind, the objects of the invention are achieved in a method of producing thin/thick effects in a filament yarn whereby the incompletely stretched filament yarns having thick regions of less stretching interrupted by thin regions of greater stretching, is interconnected over its entire length with a fully stretched filament yarn, i.e. a filament yarn which has been completely stretched over its entire length. The result is a composite yarn which has the advantage that even under significant exposure to light, both the strength and the elongation of the product remain high.

The method of the invention thus can comprise the steps of:

(a) providing at least one first filament stretched differently at spaced apart locations of the first filament to form a partially stretched filament having portions of different thicknesses spaced therealong;

(b) providing at least one second filament fully stretched over an entire length thereof; and (c) combining the first and second filaments into a thin/thick effect yarn having the portions of different thicknesses distributed over the length of the thin/thick effect yarn.

Of course, in step (a), the first filament may be intermittently stretched by repeatedly engaging and releasing the filament while exerting a tractive force thereon downstream from the location at which the filament is engaged and released, or by maintaining a constant resistance to traction at an upstream end and alternately increasing and decreasing the traction applied at the downstream end of the stretching zone, or both. The partially stretched first filament with its alternating thick and thin regions may be fed directly to the stage at which it is combined with the second filament or may be wound in a yarn package which is subsequently used to supply the first filament to the combining region.

Similarly, the second filament may be continuously and uniformly fully stretched over its entire length as part of the process in which it is combined with the first filament or can be produced and wound up in a yarn package from which the combining step is supplied.

In spite of the presence of incompletely stretched thicker regions, the composite yarn has high strength and elongation, even after substantial exposure to even intense light by virtue of the presence of the high-strength fully-stretched filaments. As the starting material in the thick/thin yarn in each case, a filament precursor yarn of greater or lesser preorientation can be used.

The combining of the two filaments can be effected, in accordance with the invention prior to or subsequent to the generation of the thick regions, by a twisting of the two yarns together, a winding of one yarn about the other or a nub entanglement of the two yarns in one or two stages.

According to one feature of the invention, in a first yarn-finishing step, a segmentwise partially unstretched filament and a fully stretched filament are formed and in a second yarn-finishing step the partially unstretched filament and the fully stretched filament are interconnected to form the thin/thick effect yarn.

Alternatively, in a first yarn-finishing step, a fully stretched filament and in a second yarn-finishing step a segmentwise partially unstretched filament is formed and interconnected with the fully stretched filament to form the thin/thick effect yarn.

According to another feature of the invention, in a single yarn-finishing step a segmentwise partially unstretched filament and a fully stretched filament are formed and the partially unstretched filament and the fully stretched filament are interconnected to form the thin/thick effect yarn.

In another alternative, in a first yarn-finishing step, filamentary precursor yarn having a low degree of orientation and a filamentary precursor yarn of a higher degree of orientation are interconnected and, in a second yarn-finishing step, the interconnected filamentary precursor yarns are stretched at a stretching ratio such that the yarn of the higher degree of orientation is fully stretched.

According to another feature of the invention, in a single yarn-finishing step, a filament precursor yarn with a lesser degree of orientation is connected with a filament precursor yarn with a higher degree of orientation and the two yarns are stretched together with a stretching ratio such that the precursor yarn with the higher degree of orientation is fully stretched and the precursor yarn with the lesser degree of orientation is stretched segmentwise and thus has regions of greater and lesser thickness.

The apparatus for producing the thick/thin yarn can comprise at least an input unit for feeding a yarn and an output unit for advancing the yarn with at least one stretching zone between these yarns and means for intermittently applying tension to a precursor yarn by either intermittently releasing the resistance to traction thereon in intermittently increasing traction thereon or both. According to the invention, such means is combined with means for interconnecting at least one fully stretched filament yarn with a filament yarn which is intermittently unstretched or at least stretched segmentwise to a lesser extent and thus to form the thick/thin effect.

BRIEF DESCRIPTION OF THE DRAWING

The above and other objects, features, and advantages will become more readily apparent from the following description, reference being made to the accompanying drawing in which:

FIG. 2 is a diagram showing a modification of a portion of the apparatus of FIG. 1;

FIG. 3 is a view similar to FIG. 2 showing another modification;

FIG. 7 is a diagram showing a portion of the apparatus corresponding to that of FIG. 5 in another modification;

SPECIFIC DESCRIPTION

In the description below, there is a mention of incompletely oriented filament yarn which may be a low-oriented yarn (LOY), a middle-oriented yarn (MOY), a preoriented yarn (POY), or even a high-oriented yarn (HOY), referring to precursor yarns having different degrees orientation and which can be used as a precursor for producing fully stretched and thus fully oriented mono or multifilament structures. These products are intermediate products in the process of the invention so that when they enter the stages to be described below in FIGS. 1–11, these stages can be considered yarn-finishing stages.

In prior art uses of such intermediate products, they are customarily stretched for full orientation of the respective filament molecules. The degree of stretching required for full orientation, namely the stretching ratio, will depend upon the degree of any preorientation. When such precursor yarn is subject to intermittent stretching, then of course thick and thin portions will develop in that yarn and the regions which may have been stretched to full orientation will have full strength whereas the thick regions, which invariably are incompletely stretched, can be subject to degradation upon exposure to high-intensity light and in any event will have reduced strength.

Figure 1:
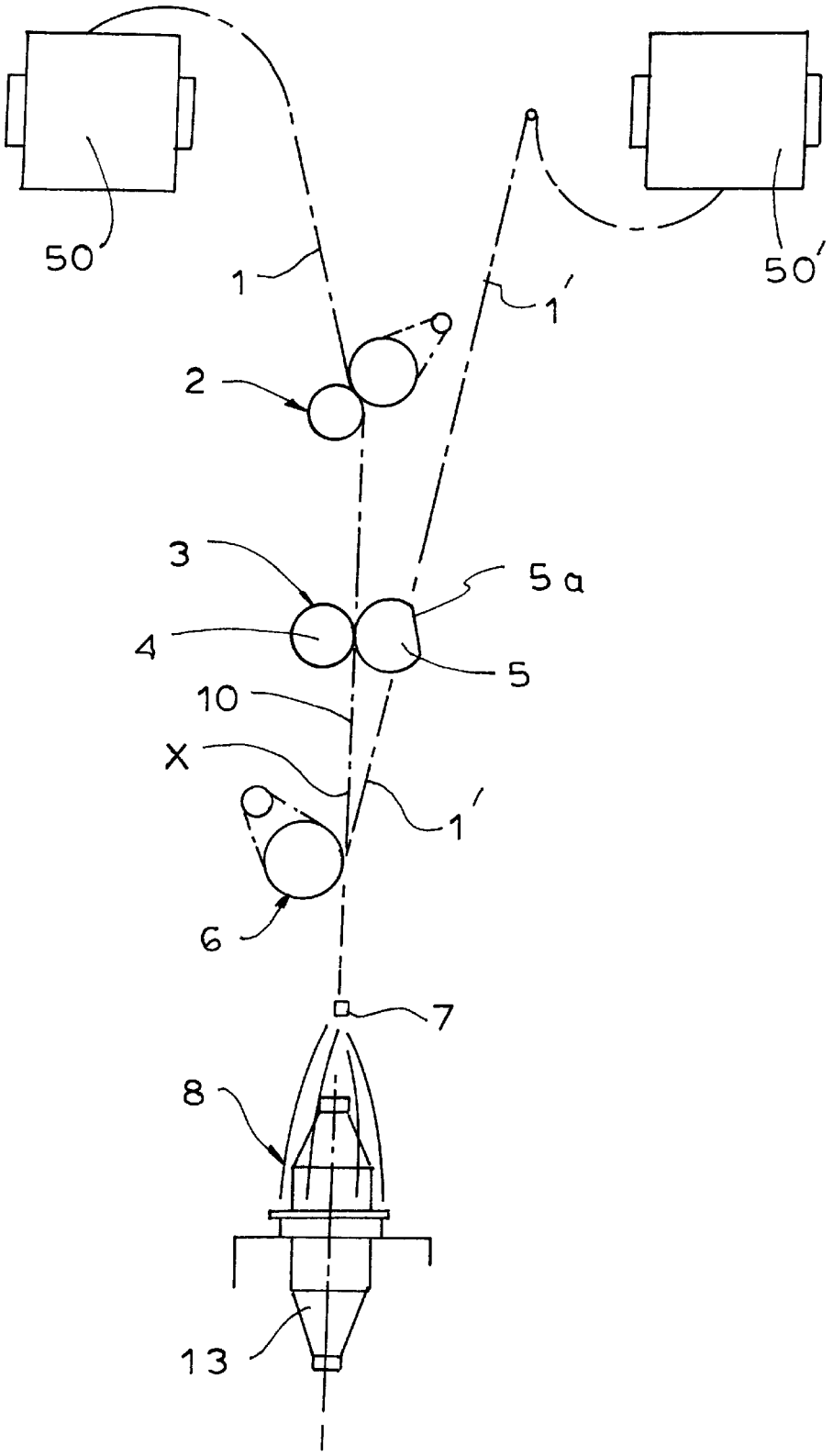
FIG. 1 is a diagram showing an apparatus for carrying out one aspect of the invention.

In FIG. 1, a supply spool 50 supplies an incompletely oriented or precursor yarn 1 to an upstream roller pair 2 which deliver this yarn to an upstream roller pair 3. The latter can have a driven roller 4 and a pressure roller 5 provided with flat 5*a* forming a thickened portion 10 in the yarn 1 while the latter is stretched in the nonthickened regions over a galette/positioning roller assembly 6.

The flat 5*a* serves to intermittently and briefly interrupt the resistance provided to traction of the yarn 1 by the galette 6 so that during the intervals at which the tension is reduced in the yarn 1, the thickened portions 10 are formed. When the yarn 1 is firmly engaged between the rollers 4 and 5 and full traction is applied, stretched regions are formed directly downstream of the rollers 4 and 5. Stretching is thus effected in a stretching zone I formed between the roller pair 3 and the galette 6. The resulting yarn X with alternating thick and thin regions is combined on the galette 6 with a fully stretched yarn 1' deriving from a yarn package 50'.

From the galette 6, the yarns X and 1' pass through a thread guide 7 and thence are collected on the bobbin 13 via a ring-twisting unit represented at 8.

The apparatus shown in FIG. 1 can also be used to achieve incomplete stretching of a precursor yarn which is not fully oriented when the pressure roller 5 is cylindrical and the stretching ratio in the stretching field between the feed rollers 2 and the rollers 3 is sufficiently small as to preclude full stretching or orientation of the yarn 1.

The ring-twisting unit 13 may be provided with a raisable and lowerable ring rail on which a traveller is dragged by the looped composite yarn passing therethrough.

In the embodiment of FIG. 2, the precursor yarn formed with alternating thick and thin regions and represented at X, passes around the galette/positioning roller assembly 6 in the manner previously described with the thick/thin effect being generated as described and the combination of the two yarns 1 and 1' is then fed through a device 8' for the nub entanglement of the two yarns before the composite yarn is wound on a yarn package 13'. The nub entanglement unit 8' is connected to a source of compressed air which is introduced as a jet into the unit 8' to generate loops and the like in unit 8' to effect the entanglement. The yarn which emerges from the yarn 8' is further textured with the knots and nubs resulting from this entanglement.

The embodiment of FIG. 3 shows a system in which the fully-stretched yarn 1' is wound around the yarn X which can be formed as has been described in connection with FIG. 1. In this case, a winder 8" carrying a winding spool 17 from the fully-stretched yarn 1' is paid out, can be provided. The spool 17 as a rule will be provided with a drive for rotating it about its axis.

In the embodiments of FIGS. 2 and 3, a stretching zone I is provided as has been described in connection with FIG. 1, together with the feed roll pair 2 and, in the case of FIG. 2, the two supply packages 50 and 50'.

In FIG. 1 the thick/thin yarn X and the fully-stretched yarn 1' are joined by twisting whereas in FIG. 2 they are joined by nub entanglements and in FIG. 3 by winding of one yarn around the other.

Figure 8:
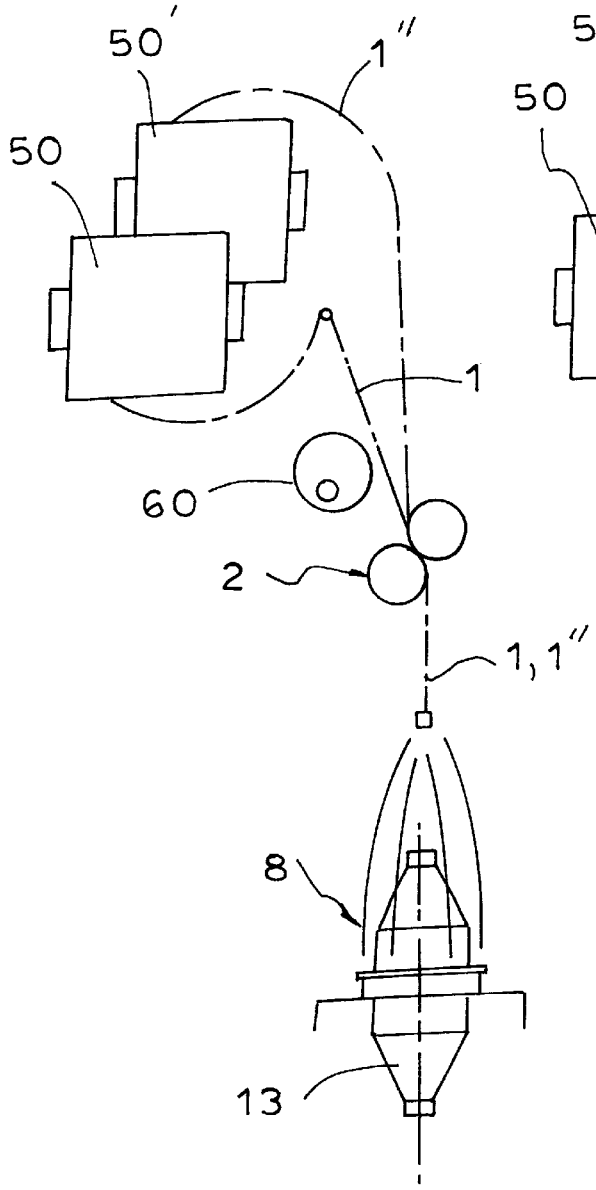
FIG. 8 is a diagram illustrating a third system for forming a composite yarn.
Figure 9:
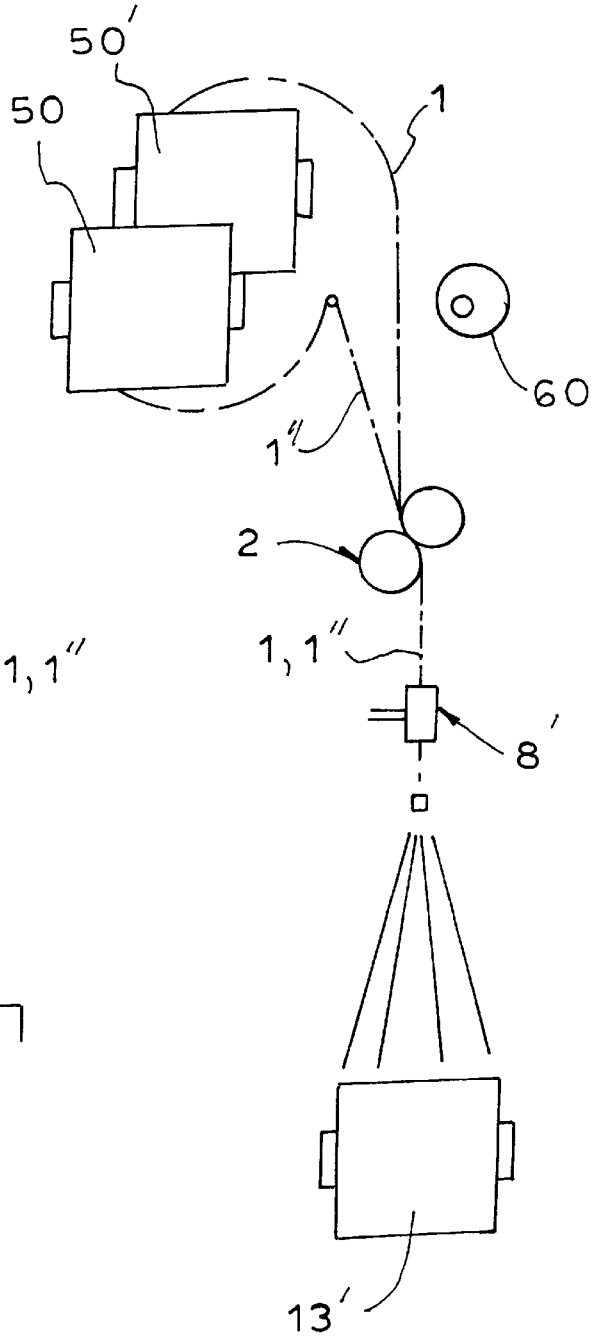
FIG. 9 is a diagram of an apparatus representing a modification of FIG. 8.

In the embodiments of FIGS. 8 and 9, two yarn packages 50 and 50' are provided which can supply a filament precursor yarn 1 with a reduced degree of orientation and a filament yarn 1" with a higher degree of orientation which does not, however, reach the level of full orientation as described.

Figure 4:
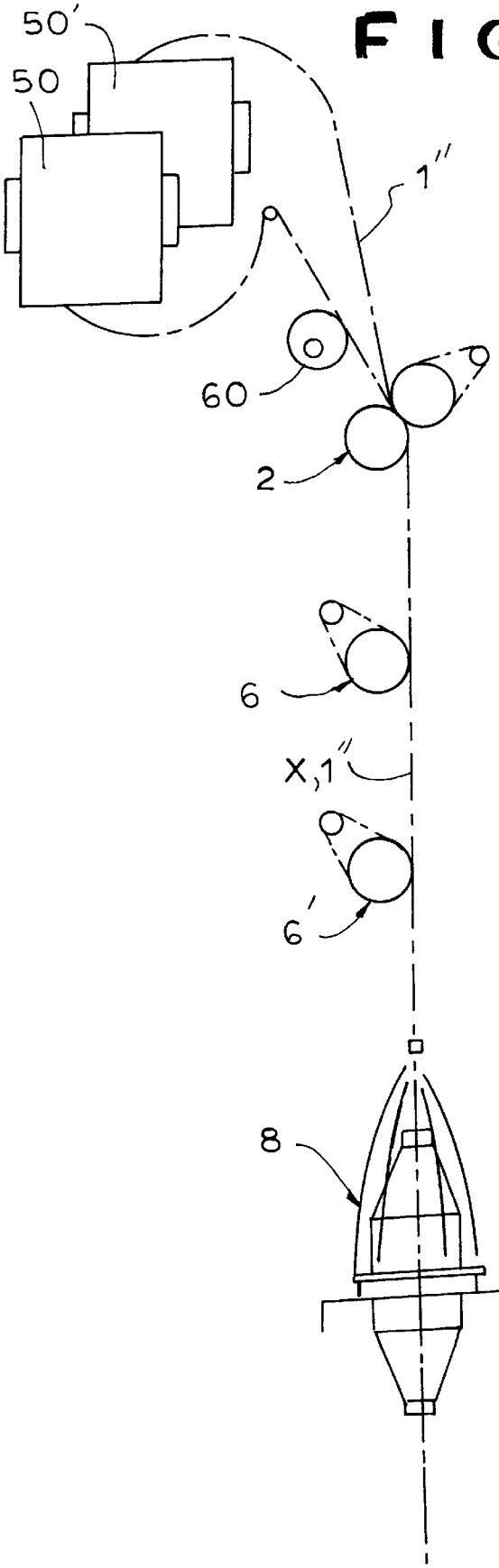
FIG. 4 is a diagram of another system for producing the composite yarn having a thick/thin effect.

The two yarns 1 and 1" in the embodiments of FIG. 4 come together upstream of the common feet unit 2 and then pass together around the galette assembly 6 and 6' which are spaced apart by a stretching zone. The galettes 6 and 6' are operated at a relatively low speed and a relatively high speed, respectively, to establish a stretching ratio between them, this ratio being so selected that the precursor yarn 1" with the higher degree of orientation is fully stretched and becomes the support yarn. The filament precursor yarn 1 with the reduced degree of orientation is stretched so that it contains partially unstretched regions as represented at 10 and thus forms a thick/thin yarn.

Figure 5:
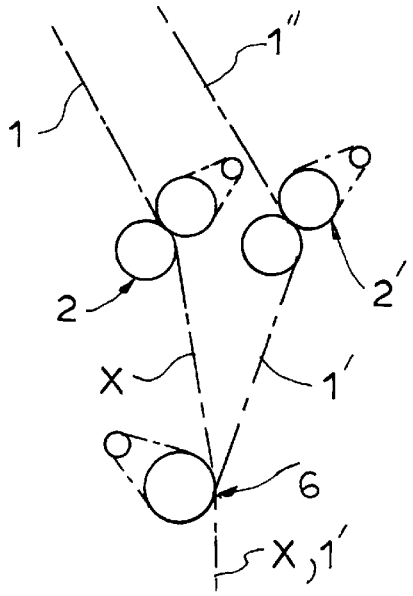
FIG. 5 is a diagram of a modification of the system of FIG. 4.

In the embodiment of FIG. 5, instead of a common feed unit 2 as in FIG. 4, separate feed units 2 and 2' are provided which enables the pretension on the yarns 1 and 1" to be separately established at the upstream side of the stretching field. The main stretching of both yarns can be effected between the galettes 6 and 6'. Separate galettes 6 can also be used if desired to provide separate stretching fields between the feed roller pairs 2 and 2' and these galettes, while a common output galette 6' is provided as has been shown in FIG. 7 for example.

Figure 6:
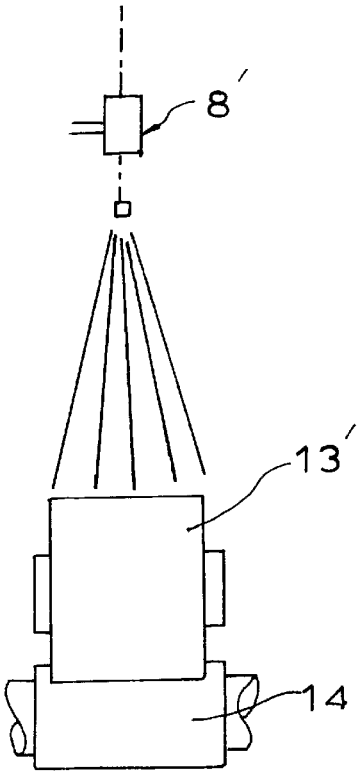
FIG. 6 is a diagram of still another modification.

FIG. 4 shows a twisting unit 8 for combining the two yarns in the manner described in connection with FIG. 1 while FIG. 6 shows that a nub entanglement system can also be used for the embodiments of FIGS. 4, 5 and 7. By analogy the winding system of FIG. 3 can also be used for combination of the yarns in the embodiments of FIGS. 4, 5 and 7.

Figure 10:
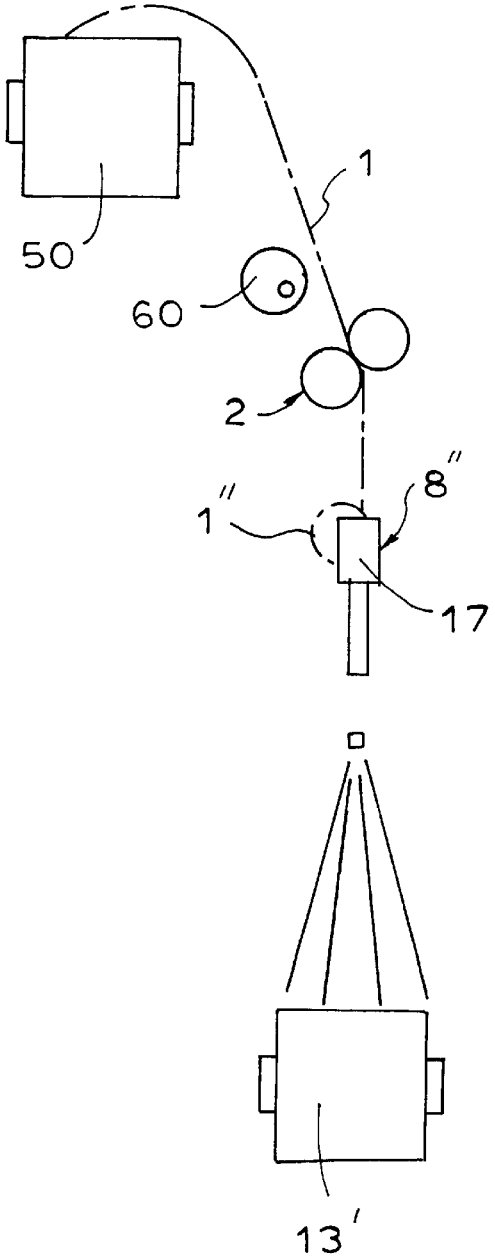
FIG. 10 is a diagram of an apparatus showing still another modification of the system of FIG. 8.

The embodiments of FIGS. 8–10 represent part of a two-stage process. In a first stage, two filamentary yarns with different degrees of orientation are fed via, for example, feed rollers 2, two yarns being advanced by the feed rollers 2 in FIGS. 8 and 9 and only one yarn via the feed rollers of FIG. 10 and the two yarns are combined by ring twisting at 8 in FIG. 8 to form the bobbin 13 and by nub entanglement at 8' in FIG. 9 to form the yarn package 13' and by winding of the second filament 1" around the first at 8" from the spool 17 to form the yarn package 13' in FIG. 10. In this case, the filament, for example, with the higher degree of orientation is supplied by the spool 17 analogously to FIGS. 3.

Figure 11:
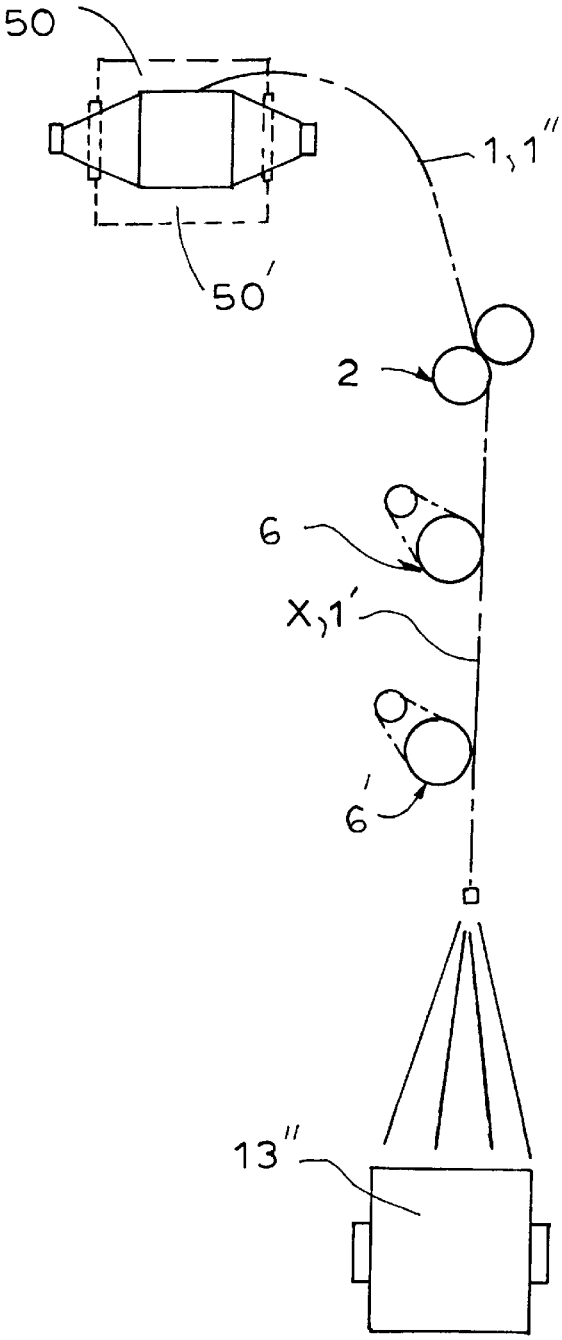
FIG. 11 is a diagram of another apparatus showing a further step in the processing of a composite yarn as formed in any one of FIGS. 8–10.

In a second stage in which the first-stage bobbin 13 or the yarn packages 13' of FIGS. 8–10 form the supply 50 and 50' for the second stage, the ply yarns 1, 1" can be subjected to a single stage stretching to form both the thick/thin yarn X and the fully-stretched yarn 1' between, for example, the galettes 6 and 6' as shown in FIG. 11 in an analog to the embodiment of FIG. 4. The product can be wound upon the yarn package 13" as has also been shown in FIG. 11. In the second stage in which the main stretching field is contained, a device similar to that shown at 5, 5*a* can be provided to assist in forming the thick/thin regions.

Since the yarn X, 1' has already been combined in the first stage, in the second stage only the formation of the thick/thin effect by stretching is required. It will be self-understood, however, that the product before being wound on the yarn package 13' can be passed through a twister for nub entanglement yarn as has already been described or can be joined with another effect yarn, a further thick/thin filament or a further fully-stretched filament and then subjected to twisting, nub entanglement or even winding of one yarn about the other before being wound on the yarn package 13" utilizing any of the techniques already described in connection with FIGS. 1–10.

The lengths, the spacings and the relative thicknesses of the thick and thin regions can be varied in the final product by the intensity with which the support yarn and the effect yarn are joined. For example higher numbers of turns per unit length, a closer spacing of the knots or nubs formed by the entanglement and higher twisting numbers per unit length will shorten the distance between thick and thin regions and also the lengths thereof along the finished product.

At least one of the two processing steps of stretching (FIG. 4 or FIG. 11) or the joining of the filaments (FIGS. 1–3) is preferably carried out with an apparatus which also carries out the other process step on at least one of the filament components. It is also possible, however, to carry out the step of forming the thick/thin yarn in one apparatus and in another apparatus to fabricate the fully-stretched yarn and to combine both of the filament components in still a third apparatus.

Conceptually the sequence described in connection with FIGS. 8–10 on the one hand and FIG. 11 on the other hand can be reversed. For example, utilizing the apparatus of FIG. 11, a fully-stretched filament yarn can be produced to form a yarn package 13" of such fully stretched filament yarn. A similar apparatus can be used to form only a thick/thin effect yarn on another yarn package 13" or a partially-stretched yarn and the two yarn packages thus produced can be processed utilizing the apparatus of FIGS. 8, 9 or 10 and either the twisting unit 8, the nub entanglement unit 8' or the winding system 8" of these Figures. The bobbin 13 or the yarn packages 13' would then carry the thick/thin effect yarn supported by the fully-stretched yarn. In all of these processes a segmentwise unstretched or only partially stretched filament yarn is so plied with the fully-stretched yarn as to provide long-term strength even in the presence of intensive illumination.

In FIGS. 5 and 7 and thus in the line running to the winder 8' and 6 as well, the alternating thick and thin regions can be provided in the filament 1 by providing flats as shown at 5*a* on one of the rollers engaging the filament. In a different approach to providing alternating thick and thin regions, a hot eccentric cam can contact the filament 1 to heat it to a temperature in which the heated region will stretch to a greater extent than a nonheated region and thus the filament will become thinned out in the heated region.

A similar heated cam can be provided in the embodiments of FIGS. 8, 9, 10 and 11, where required, to reduce alternating thick or thin regions in one of the filaments before the support filament is combined with the effect filament and the combined yarns are drawn in FIG. 11.

As a general matter when the two yarns are stretched simultaneously, i.e. after combining or even before combining and passage over the same galettes, it is important that there be a difference in the degrees of stretch of the two yarns prior to the stretching of them jointly, to insure that the thin/thick yarn will remain the effect yarn while the support yarn will be stretched to its maximum strength. That difference at a minimum is 5% and at a maximum can be 30%. Best results are obtained when the thick/thin yarn is stretched to 40 to 80% of the maximum strength stretching and thus 60 to 80% of the stretch applied to the support yarn.

I claim:

1. A method of producing a thin/thick effect in a filament yarn, comprising the steps of:

(a) providing at least one first filament stretched at spaced apart locations of said first filament differently from a stretch at other locations of said first filament to form a partially stretched first filament having portions of different thicknesses spaced therealong;

(b) providing at least one second filament fully stretched over an entire length thereof; and (c) combining said partially stretched first filament and second filament into a thin/thick effect yarn having said portions of different thicknesses distributed over the length of said thin/thick effect yarn.

2. The method defined in claim 1 wherein, in a first yarn-finishing step, a segmentwise partially unstretched filament corresponding to the partially stretched first filament of step (a) and a fully stretched filament corresponding to the second filament of step (b) are formed and in a second yarn-finishing step corresponding to step (c) the partially unstretched filament and the fully stretched filament are interconnected to form the thin/thick effect yarn.

3. The method defined in claim 1 wherein, in a first yarn-finishing step, a fully stretched filament corresponding to the second filament of step (b) and in a second yarn-finishing step a segmentwise partially unstretched filament corresponding to the partially stretched first filament of step (a) is formed and interconnected with the fully stretched filament to form the thin/thick effect yarn as produced in step (c).

4. The method defined in claim 1 wherein, in a single yarn-finishing step a segmentwise partially unstretched filament corresponding to the partially stretched first filament of step (a) and a fully stretched filament corresponding to the second filament of step (b) are formed and the partially unstretched filament and the fully stretched filament are interconnected to form the thin/thick effect yarn as produced in step (c).

5. The method defined in claim 1 wherein, in a first yarn-finishing step, precursor filament corresponding to the partially stretched first filament of step (a) having a low degree of orientation and a filamentary precursor yarn of a higher degree of orientation are interconnected to form a composite yarn and, in a second yarn-finishing step, the composite yarn is stretched at a stretching ratio such that the filament of the higher degree of orientation is fully stretched to correspond to the second filament of step (b).

6. The method defined in claim 1 wherein, in a single yarn-finishing step, a precursor filament corresponding to the partially stretched first filament of step (a) having a lower degree of orientation is combined with a precursor filament having a higher degree of orientation and the two filaments after combination are stretched in combination with a stretching ratio so selected that the precursor filament with the higher degree of orientation is fully stretched to correspond to the second filament of step (b) and the precursor filament with the lesser degree of orientation remains segmentwise stretched to a lesser degree than regions in between the regions of stretch to a lesser degree.

7. The method defined in claim 1 wherein the first and second filaments are combined in step (c) by twisting them together.

8. The method defined in claim 1 wherein said first and second filaments are combined in step (c) by knot entanglement.

9. The method defined in claim 1 wherein said first and second filaments are combined in step (c) by winding one of the first and second filaments around the other of the first and second filaments.

10. An apparatus for producing a thin/thick effect in a filament yarn, comprising:

an upstream feed unit and a downstream feed unit for advancing filaments between them and defining a stretching zone, said upstream feed unit and said downstream feed unit being operable to stretch a precursor filament segmentwise to produce a segmentwise partially unstretched filament; and means for combining said segmentwise partially unstretched filament and a fully-stretched filament to form by combination of said filaments a thin/thick effect combined yarn having portions of different thicknesses distributed over the length thereof and supported by said fully-stretched filament.

11. The apparatus defined in claim 10 wherein said means for combining includes a twister for twisting said filaments together.

12. The apparatus defined in claim 10 wherein said means for combining includes a device for winding one of said filaments around the other of said filaments.

13. The apparatus defined in claim 10 wherein said means for combining includes a knot entanglement through which said filaments are passed.

14. The apparatus defined in claim 10 wherein one of said units includes common means for feeding a segmentwise unstretched filament and a fully-stretched filament together.

15. The apparatus defined in claim 10 wherein said units are constructed and arranged for stretching segmentwise a precursor filament with reduced degree of orientation and complete stretching of a precursor filament with a higher degree of orientation.

16. The apparatus defined in claim 10 which comprises a first stretching means for fully stretching the precursor fully stretched filament with a higher degree of orientation and a second stretching means segmentwise stretching a precursor filament with a reduced degree of orientation, said first and second stretching means having separate upstream feed units and a common downstream feed unit.

17. The apparatus defined in claim 10 wherein said upstream unit feeds both of said filaments in common to the downstream feed unit.

* * * * *